United States Patent [19]

Karman

[11] Patent Number: 4,756,530

[45] Date of Patent: Jul. 12, 1988

[54] ROTATING SPHERICAL SHELL GAME OR TOY

[76] Inventor: Karoly Karman, 2421 Trent Street, Victoria, British Columbia, Canada, V8R 4Z4

[21] Appl. No.: 70,377

[22] Filed: Jul. 7, 1987

[30] Foreign Application Priority Data

Mar. 17, 1987 [CA] Canada ..... 531963

[51] Int. Cl.[4] ..... A63B 37/00; A63B 67/14

[52] U.S. Cl. ..... 273/113; 273/110; 273/156; 273/58 F

[58] Field of Search ..... 273/58 F, 110, 109, 273/113, 153 S, 156, 157 A

[56] References Cited

U.S. PATENT DOCUMENTS

| | | | |
|---|---|---|---|
| 693,821 | 2/1902 | Ford | 273/58 F |
| 3,655,197 | 4/1972 | Milbaum | 273/58 F |
| 3,995,855 | 12/1976 | Schultz | 273/58 F |
| 4,451,038 | 5/1984 | Nagy | 273/110 |

FOREIGN PATENT DOCUMENTS

| | | | |
|---|---|---|---|
| 3101088 | 8/1982 | Fed. Rep. of Germany | 273/58 F |
| 846327 | 6/1939 | France | 273/58 F |

*Primary Examiner*—Richard C. Pinkham
*Assistant Examiner*—Gary Jackson
*Attorney, Agent, or Firm*—R. William Wray & Associates

[57] ABSTRACT

A puzzle game or toy is disclosed comprising two spherical shells made of hard plastic or metal material and having over their surface a multiplicity of circular holes cut therein in a random pattern, the holes being of equal diameter with the exception of one hole having a slightly larger diameter. The second spherical shell has an inner diameter slightly larger than the diameter of the first spherical shell and mounted over the first shell such that the two shells are freely rotatable relative to each other. A spherical ball of metal or plastic is positioned inside the two spherical shells and is of a diameter such that it will pass through the two large holes but none of the other holes.

4 Claims, 1 Drawing Sheet

ROTATING SPHERICAL SHELL GAME OR TOY

SUMMARY OF THE INVENTION

This invention relates to a novelty game or toy and more particularly to a rotating spherical shell game or toy that will provide hours of entertainment to young and old alike.

Over the centuries many kinds of puzzle type games or toys have been devised. The ancient Chinese puzzle goes back centuries and is still being used to give entertainment to many. Recently the Rubik Cube has been an exciting puzzle game.

It is an object of the present invention to provide a manually operable puzzle game or toy that is not readily or easily solvable.

This and other objects of the invention are achieved by a puzzle game or toy comprising a first spherical shell of a size that can be readily manipulated by hand and made of hard plastic or metal material, and having over its surface a multiplicity of circular holes cut therein in a random pattern, said holes all being of equal diameter with the exception of one hole having a slightly larger diameter, a second spherical shell similar to the first but having an inner diameter slightly larger than the outer diameter of the first spherical shell and mounted over the first shell such that the two shells are freely rotatable relative to each other, said second spherical shell having an identical pattern of holes cut in its surface such that at only one relative position of the two shells, the two patterns of holes are completely in line with the one large hole in the outer shell overlying the one large hole in the inner shell, and a spherical ball of metal or plastic positioned inside the two spherical shells and of a diameter such that it will pass through the two large holes but none of the other holes.

BRIEF DESCRIPTION OF THE DRAWINGS

In drawings which illustrate embodiments of the invention.

DETAILED DESCRIPTION OF THE INVENTION

Figure 1A:
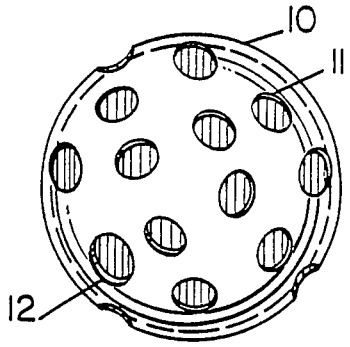
FIGS. 1*a*, 1*b* and 1*c* are views of the three parts of the device before it is assembled.
Figure 1B:
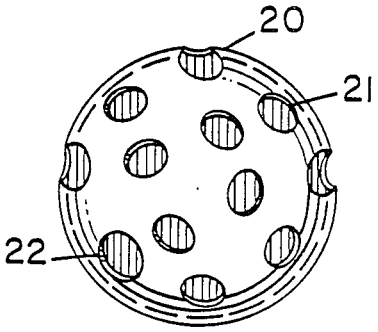
Figure 1C:
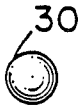

Referring to FIG. 1*a*, the puzzle game consists of an outer spherical shell 10 made of hard plastic or metal and of a size that can be readily manipulated by hand. Over the surface area of this shell is cut or formed a multiplicity of circular holes 11 in a random pattern. The number of holes should be large and at least 10 or more and the random pattern should be such that there is no particular geometrical order to the positions. The number of holes would preferably be between 25 and 50. In a toy built and tested the number was 36. The diameter of the holes are all the same with the exception of one hole 12 that has a diameter slightly larger than the rest. FIG. 1*b* is the inner shell 20 with holes 21. This shell is identical to the outer shell but has an outer diameter slightly smaller than the inner diameter of the outer shell 10. The pattern and the diameter of holes 21 are the same as that of the outer shell 10 and with one hole 22 having the same larger diameter as that of hole 12. FIG. 1*c* shows a spherical ball 30 made of metal or hard plastic which has a diameter larger than holes 11 and 21 but smaller than holes 12 and 22.

Figure 2:
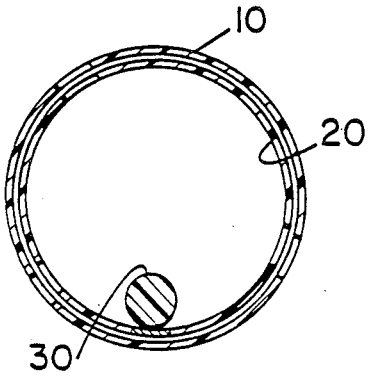
FIG. 2 is a view of the device in its "ready to play" state.

FIG. 2 is a cross-section of the device assembled with shell 20 fitting smoothly inside shell 10. The surfaces must be smooth and the fit should be close but free enough to allow ready movement of one shell relative to the other. Ball 30 lies loosely inside.

The object of the game puzzle is to get the ball out of the shells and this can be done by manipulating the two shells relative to each other until the random pattern of holes in the two shells are lined up and in register. At this position the two larger diameter holes 12 and 22 overly each other and are lined up such as to allow ball 30 to drop out. It will be appreciated that there may, in fact, be several relative positions of the spheres where the two large diameter holes 12 and 22 overly each other and are lined up such as to allow ball 30 to drop out. However there is only one position where all the holes are in-line. The shells can be manipulated by the fingers. If need be a shaped rod or stylus might be used.

Figure 3:
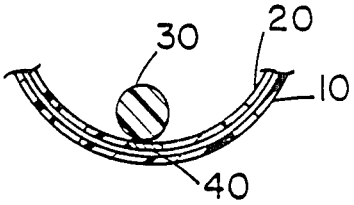
FIG. 3 is a cross-section of the inner shell including a weight for positioning purposes.

FIG. 3 is a cross-section of a portion of the two shells 10 and 20 with a piece of weighting material, for example metal in the case of plastic shells, inserted in shell 20. The purpose of this weight 40 is to maintain by gravity the inner shell to a set position allowing relative motion of the outer shell by hand.

It will be readily apparent to a person skilled in the art that a number of variations and modifications can be made without departing from the true spirit of the invention which will now be pointed out in the appended claims.

I claim:

1. A puzzle game or toy comprising:

(a) a first spherical shell of a size that can be readily manipulated by hand and made of hard plastic or metal material, and having over its surface a multiplicity of circular holes cut or formed therein in a random pattern said holes all being of equal diameter with the exception of one hole having a slightly larger diameter.

(b) a second spherical shell similar to the first but having an inner diameter slightly larger than the outer diameter of the first spherical shell and mounted over the first shell such that the two shells are freely rotatable relative to each other, said second spherical shell having an identical pattern of holes formed in its surface such that at only one relative position of the two shells, the two patterns of holes are completely in line with the one large hole in the outer shell overlying the one large hole in the inner shell, and (c) a spherical ball of metal or plastic positioned inside the two spherical shells and of a diameter such that it will pass through the two large holes but none of the other holes.

2. A puzzle game or toy as in claim 1 wherein the first spherical shell has implanted or embedded at a single position therein, a piece of heavy metal material such as to cause the inner shell to move by gravity to a downward position.

3. A puzzle game or toy as in claim 1 or claim 2 wherein the number of holes in each of the spherical shells is between 25 and 50.

4. A puzzle game or toy as in claim 1 or claim 2 wherein the number of holes in each of the spherical shells is about 36.

* * * * *